US006808655B1

(12) United States Patent
Perichon et al.

(10) Patent No.: US 6,808,655 B1
(45) Date of Patent: Oct. 26, 2004

(54) METHOD FOR PREPARING ORGANO-ZINC DERIVATIVES BY ELECTROCHEMICAL PROCESS ASSOCIATED WITH A COBALT SALT CATALYSIS

(75) Inventors: Jacques Perichon, Savigny-sur-Orge (FR); Corinne Gosmini, Savigny-sur-Orge (FR); Yolande Rollin, Boissy-Saint-Leger (FR)

(73) Assignee: Rhodia Chimie, Boulogne Billancourt Cedex (FR)

( * ) Notice: Subject to any disclaimer, the term of this patent is extended or adjusted under 35 U.S.C. 154(b) by 117 days.

(21) Appl. No.: 10/019,145

(22) PCT Filed: Jun. 30, 2000

(86) PCT No.: PCT/FR00/01865

§ 371 (c)(1),
(2), (4) Date: Dec. 20, 2001

(87) PCT Pub. No.: WO01/02625

PCT Pub. Date: Jan. 11, 2001

(51) Int. Cl.[7] ..... H01B 1/12; C25B 3/12
(52) U.S. Cl. ..... 252/519.2; 205/457
(58) Field of Search ..... 205/457; 252/519.2

(56) References Cited

FOREIGN PATENT DOCUMENTS

JP 56005541 A * 1/1981 ..... G03C/1/72

OTHER PUBLICATIONS

Abstract only.*
Gosmini C et al: "Electrosynthesis of 3–Thienylzinc Bromide from 3–Bromothiophene via a Nickel Catalysis" Tetrahedron Letters, NL, Elsevier Science Publishers, Amsterdam, vol. 38, No. 11, Mar. 17, 1997, pp. 1941–1042, XP004055821, ISSN: 0040–4039 cited in the application.
International Search Report Nov. 21, 2000.

* cited by examiner

*Primary Examiner*—Edna Wong

(57) ABSTRACT

A liquid conductive composition for electrolytic use, comprises a cobalt salt, a zinc salt, a polar aprotic solvent of said salts and a cobalt ligand. The liquid composition is used in a process for the preparation of an organozinc compound by electrolytic synthesis. The process comprises the step of subjecting to an electrolysis on an inert cathode the liquid composition comprising a cobalt salt, a zinc salt, a solvent, a cobalt ligand, and an organic halide, and recovering the organozinc obtained by the electrolysis.

10 Claims, No Drawings

METHOD FOR PREPARING ORGANO-ZINC DERIVATIVES BY ELECTROCHEMICAL PROCESS ASSOCIATED WITH A COBALT SALT CATALYSIS

This application is an application under 35 U.S.C. Section 371 of International Application No. PCT/FR00/01865 filed on Jun. 30, 2000.

The present invention relates to a novel process for synthesizing aryl organozinc derivatives. The invention relates more particularly to the electrolytic synthesis of aryl organozinc derivatives, in the catalytic presence of the element cobalt.

The reactivity of organozinc reagents, especially aryl organozinc reagents, shows many specificities which would make them particularly advantageous in many organic synthesis operations. However, they are difficult to obtain and are often prepared from organometallic reagents made with more electronegative metals, that is to say more reductive metals.

In addition, most of the techniques require the use of highly aprotic and especially very dry media.

In particular, reactions for the electrolytic synthesis of organozinc reagents present the risk of two unwanted reactions: firstly, the reduction reaction to give a hydrogenated derivative, and secondly, a coupling reaction (formation of biaryl)

A certain number of tests have been conducted in an attempt to perform this synthesis electrolytically. The tests that were the most conclusive were performed by some of the authors of the present invention.

Mention may be made more particularly, firstly, of the general textbook "Organozinc reagent, a practical approach" (Paul KNOCHEL and Philip JONES Editors, Oxford University Press, December 1998). More particularly, a synthetic route is described therein in chapter 8 by S. SIBILLE, V. RATOVELOMANANA and J. PERICHON (see also Journal of Chemical Society Chemical Communications, 1992, 283–284) and the article by C. GOSMINI, J. Y. NEDELEC and J. PERICHON (Tetrahedron Letters, 1997, 38, 1941–1942).

In these articles, the only route that is described therein is the use of very specific nickel complexes as electrolytic synthesis catalysts, in a limited number of media. However, the use of these nickel complexes, although constituting an important innovation, does not generally make it possible to achieve high yields relative to the haloaryl substrate.

Accordingly, one of the aims of the present invention is to provide a process for obtaining organozinc derivatives in good yields, both in terms of reaction yields (RY) and degrees of conversion (DC). In other words, one of the aims of the present invention is to provide a technique which allows the conversion of the substrate with good selectivity (CY).

Another aim of the present invention is to provide a technique for reducing the reduction and coupling reactions.

Another aim of the present invention is to provide a route that is capable of catalyzing the electrolytic synthesis reaction of aryl organozinc reagents, starting with the corresponding halo derivatives.

These aims and others, which will emerge hereinbelow, are achieved by means of using cobalt as a catalyst in the electrolytic synthesis of arylzinc compounds.

According to the present invention, it has been shown that cobalt can be introduced especially into the electrolyte in oxidation state II. Admittedly, cobalt can also be introduced in the form of cobalt III, but, since the medium is a reductive medium, this form will have a tendency to disappear very rapidly to be converted into various species, and especially into cobalt II. The state and form of the catalytically active cobalt have not been completely elucidated.

According to one preferred embodiment of the present invention, it is desirable to use cobalt in the presence of at least one of its ligands.

The coordination of the cobalt is advantageously performed with compounds (solvents or solvating agents) that have a high donor number. More specifically, it may be pointed out that it is preferable that the donor number D of these solvents should be greater than or equal to 10, preferably less than or equal to 30, and advantageously between 20 and 30, the limits being included. The said donor number corresponds to the $\Delta H$ (variation in enthalpy), expressed in kilocalories, of the combination of said aprotic polar solvent or of said ligand, with antimony pentachloride. This is described more specifically in the book by Christian REINHARDT: "Solvents and Solvent Effects in Organic Chemistry—VCH, page 19, 1988". Said page gives a definition of the donor number.

It has been shown, in the course of the study which led to the present invention, that very good results are obtained when the atom coordinating to the cobalt is an atom from the nitrogen column, and advantageously nitrogen. In this case, it is preferable that the ligand atom should not bear an electric charge.

When a specific coordinating agent is used, which does not act as solvent, pyridine, nitrile, phosphine, stibine and imine, or even oxime, functions or groups may be mentioned.

When unidentate (or monodentate) ligands are used, it is desirable to use in the electrolyte a molar ratio between the ligand(s) and the cobalt which is high ([lig]/[Co] of about 10 and advantageously $\geqq$about 100); there is usually no upper limit since the ligands may serve as solvent.

When bidentate or multidentate ligands are used, it is possible to decrease the lower limit to ratios at least equal to 2, advantageously to 4 and preferably to 6, but more preferably to 8.

To be efficient, it is desirable that the cobalt should be present at a minimum concentration at least equal to $10^{-3}$ M. To be economical, it is preferable that the cobalt should not be too concentrated; thus, it is preferred that the cobalt content should be not more than 0.2 M.

The reaction medium advantageously comprises a solvent; this solvent should be polar enough to dissolve the metals or, more exactly, the metal salts used, and it should be lipophilic enough to at least partially dissolve the substrates from which it is desired to form the organozinc reagent.

It is preferable to use solvents that are sufficiently low in acidity (it is desirable that their pKa should be at least equal to 16, advantageously to 20 and preferably to 25), so that the reactions with hydrogen are as limited as possible. Thus, primary alcohols are too acidic to give very good results.

More specifically, the solvents that will be preferred are "polar aprotic" solvents such as, for example, alone or as a mixture:

purely oxygenated solvents, in particular ethers, preferably polyethers such as 1,2-dimethoxyethane or cyclic ethers such as THF or dioxane;

amides or ureas (DMF, N-methyl-2-pyrrolidone, imidazolidone, tetramethylurea, dimethoxypropyleneurea, etc.);

sulfones (for example sulfolane) or sulfoxides (such as DMSO); and provided that they are liquid under the operating conditions, nitrogenous derivatives, nitrogenous heterocycles, especially pyridine, and compounds containing a nitrile function (for those that are preferred, see below); and a provided that they are liquid under the operating conditions, complexing agents (crown ether, HMPT, tris(3,6-dioxaheptyl)amine (TDA-1)), which improve the correct functioning of the reaction by increasing the conductivity, increasing the reactivity of the anion and preventing the deposition of metal at the cathode.

Without this explanation being limiting, it would appear that these advantageous phenomena are correlated with the ability to complex the metal cations or as a mixture.

As has been mentioned previously, the solvents used may themselves act as complexing agents or ligands. They may especially, and advantageously, contain one or more of the coordination functions mentioned above.

The solvent may be a mixture of an apolar solvent and a polar solvent as defined above by the donor number.

To make the products easier to separate from the reaction media, it is preferable that said solvent should have a boiling point that is substantially different from the compound to be synthesized and from the starting compound.

To facilitate the reaction and to improve the conductivity of the medium, saline electrolytes, occasionally referred to as base salts, optionally modified by the presence of complexing agents, are generally used. These electrolytes are chosen so as not to disrupt the reactions at the anode and the cathode.

According to one of the preferred embodiments of the present invention, an excess of zinc cation, relative to the stoichiometrically required amount, may be used as base salt, advantageously in the form of a fully dissociated salt (in general corresponding to an acid whose pKa is at most equal to 3, advantageously to 2, preferably to 1 and more preferably to zero).

When a soluble anode is used, the electrolyte may be chosen so as to have as cations those corresponding to the metals of the anode.

The electrolyte may be chosen so as to have as cations metals of high transporting power such as divalent and advantageously trivalent metals, of the type such as aluminum, on condition that this does not disrupt the base reaction.

As metals used in the base salts, it is desirable to use those that have, besides the stage 0, only one stable oxidation state.

The electrolyte may be chosen such that these cations are directly soluble in the reaction medium. Thus, when the medium is sparingly polar, rather than making the metal cations soluble by means of adjuvants, it may be advantageous to use "oniums" that are stable in the electrical inactivity range.

The term "onium" means positively charged organic compounds, the name attributed to them by the nomenclature comprising an "onium" affix, generally a suffix (such as sulfonium [trisubstituted sulfur], phosphonium [tetrasubstituted phosphorus], ammonium [tetrasubstituted nitrogen]). The ones most frequently used are tetraalkylammoniums; the alkyl groups taken in their etymological sense generally contain from 1 to 12 carbon atoms and preferably from 1 to 4 carbon atoms. Phase-transfer agents may also be used.

The anions may be any common anions for inert electrolytes, but they are preferably chosen either from those released by the reaction, essentially halides, or, for example, from complex anions such as perfluoro bis-sulfonimides, $BF_4^-$, $PF_6^-$ or $ClO_4^-$. As a guide, it should be pointed out that DMF, used with, as a base salt, tetrabutylammonium tetrafluoroborate at a concentration of 0.01 M, gives good results.

Another aim of the present invention is to provide a medium that may be used to perform the electrolysis and to give organozinc reagents. This aim has been achieved by means of a composition comprising at least:

a one cobalt salt, one zinc salt, a one conductive solvent, or a solvent that is made conductive, and one cobalt ligand.

The solvent and the cobalt ligand may be one and the same species, and even a single compound when the solvent is a single compound.

The cobalt content is advantageously between $2\times10^{-1}$ and $10^{-1}$ M and preferably between $5\times10^{-3}$ and $5\times10^{-2}$ M (closed interval, that is to say limits included).

Not taking into account the organozinc reagents formed, the zinc content is advantageously between 0.05 M and the solubility limit in the medium. When a soluble zinc anode is not used, it may be envisaged that a solid phase consisting of zinc salt(s) is present.

Said composition, when it is used to prepare organozinc reagents, also comprises an aryl halide whose preferred chemical characteristics will be given later. This aryl halide is advantageously present in a concentration of from 0.1 to 1 M.

It is desirable that the molar ratio (dissolved species, needless to say not taking into account the organozinc reagents formed) of zinc to cobalt is between 100 and 1 and preferably between 10 and 2 (closed interval, that is to say limits included).

It is also recommended that the molar ratio (needless to say dissolved species, not taking into account the organozinc reagents formed) of zinc to aryl halide should be between 0.05 and 4 and preferably between 0.01 and 2 (closed interval, that is to say including the limits). The lowest values correspond to the case in which a soluble zinc anode is used.

According to one advantageous embodiment of the invention, the intensity and area of the reactive electrode, more exactly of the electrode at which the reaction takes place, are chosen such that the current density j is between 5 and $5\times10^2$ A/m$^2$ and preferably between 20 and 200 A/m$^2$ (closed interval, that is to say including the limits).

By routine tests, a person skilled in the art can determine the reduction potential of cobalt in the reaction medium and that of the aryl halide. Once this determination is done, it will preferably be between the reduction potential of cobalt and that of the aryl halide.

The substrates which may be converted into organozinc reagents by the present invention represent a wide range of compounds. The halides are generally halides corresponding to relatively heavy halogens, that is to say halogens heavier than fluorine.

It may also be mentioned as an indication that, when the halogen is linked to an electron-poor aromatic nucleus, it is preferable to use bromines or chlorines as halogen, chlorines being reserved for the nuclei that are particularly electron-poor. If the condition is satisfied by six-membered heterocycles, in the case of homocyclic aryls, to use a chloride, it is preferable that the sum of the Hammett constants ap of the substituents (not taking the leaving halide into account) should be at least equal to 0.40 and preferably to 0.50. On the other hand, the nuclei that are particularly electron-rich may use iodine as halide.

For further details regarding the Hammett constants, reference may be made to the 3rd edition of the textbook written by Prof. Jerry March "Advanced Organic Chemistry" (pages 242 to 250) and published by John Wiley & Sons.

The five-membered heterocycles comprising a chalcogen as hetero atom (such as furan and thiophene) have a large capacity to be converted into zinc reagents, show separate reactivity, and are always readily converted into zinc reagents. As a result, the use of cobalt is less critical. In their case, the element cobalt makes it possible to obtain a monozinc reagent from dihalo compounds of the same rank.

The electron-poverty of the nucleus may be due either to the presence of electron-withdrawing groups as substituents, or, in the case of six-membered nuclei, to the replacement of a carbon with a hetero atom. In other words, the electron-poor nucleus may be a six-membered heterocyclic nucleus, especially heterocyclic nuclei containing an atom from the nitrogen column and more particularly nitrogen.

Among the electron-withdrawing groups that give good results, mention should be made of acyl groups, nitrile groups, sulfone groups, carboxylate groups, trifluoromethyl groups or, more generally, perfluoroalkyl groups and halogens lower in rank than the halide which will be converted into an organozinc reagent. When the substituents are halogens of the same rank, a diorganozinc reagent is generally formed. These diorganozinc reagents constitute novel compounds and correspond to the general formulae below in which X and R both represent zinc-bearing groups.

Among the donor groups, that is to say groups giving mediocre results with chlorine but good results with bromine, mention may be made of alkyloxy groups, alkyl groups, amine groups and dialkylamine groups.

The aromatic derivative which is the substrate in the present process advantageously corresponds to the following formula:

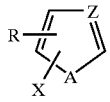

in which:

Z represents a trivalent chain unit —C($R_1$)=, an atom from column V, advantageously a nitrogen;

X represents the leaving halogen;

A represents either a chain unit chosen either from the groups ZH or from chalcogens advantageously at least equal in rank to that of sulfur, or from the two-membered divalent unsaturated groups $CR_2$=$CR_3$, N=$CR_2$, $CR_2$=N.

Insofar as they are borne by contiguous atoms, two of the radicals R, $R_1$, $R_2$ and $R_3$ may be linked to form rings.

Thus, the aryls may especially be of formula:

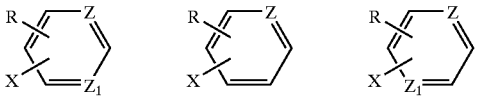

in which Z1 is chosen from the same meanings as those given for Z.

The radicals $R_1$, $R_2$ and $R_3$ are chosen from the substituents mentioned above and especially:

electron-withdrawing groups, in particular acyl groups, nitrile groups, sulfone groups, carboxylate groups, trifluoromethyl groups or, more generally, perfluoroalkyl groups and halogens of a lower rank than the halide which will be converted into an organozinc reagent;

donor groups, especially aryloxy or alkyloxy groups, hydrocarbyl groups such as aryls and alkyls (the latter word being taken in its etymological meaning) and amine groups, including groups monosubstituted and disubstituted with hydrocarbon-based alkylamine groups.

It is desirable that the substrates should contain not more than 50 carbon atoms, advantageously not more than 30 carbon atoms and preferably not more than 20 carbon atoms.

Among the substrates that are particularly advantageous are halides, preferably arylchlorides, bearing, especially in the metaposition, an aliphatic carbon (that is to say an $SP^3$ carbon) bearing at least two fluorines. For example, the halides are preferably trifluoromethylaryl chlorides.

This process for synthesizing organozinc reagents may be extended, firstly to all organozinc reagents linked to $sp^2$-hybridized carbon atoms and especially to the synthesis of organozinc reagents from vinyl halides, especially when these vinyl halides are conjugated with aromatic nuclei.

Although the technique is economically much less advantageous, it may also be advantageous to note that it can also be transposed to aliphatic halides.

One of the advantages of the present invention is that it requires only completing agents or ligands that are readily available, such as nitrites (preferably aromatic or bidentate) or pyridines and derivatives of the pyridine nucleus, such as quinoline. Moreover, bipyridyls, being bidentate, also give good results as ligands that are different from the solvent.

Although the bis-nitriles are capable of acting as bidentate ligands, they are poor completing agents and should be used in high proportions of the same order as the monodentate ligands. They give good results.

It is desirable, in order to avoid the medium being too acidic, that the bis-nitriles constituting the solvent, some of the solvent, or the ligand, should be such that, via the most direct pathway, two nitrile functions are separated by at least two carbons and advantageously three carbons.

Dinitroalkylenes in which the alkylene group contains from 2 to 8 carbon atoms give good results. Mention may be made especially of glutaronitrile, methylglutaronitrile, adiponitrile, pimelonitrile and suberonitrile.

Another advantage of the present invention is its ability to be performed readily at room temperature and, more generally, at a temperature below 50° C.

Finally, the reaction does not require an inert electrolyte, since the zinc salt can be used as inert electrolyte.

Soluble zinc anodes may be used in this technique.

The present invention produces families of organozinc compounds corresponding to the preceding substrate formulae in which X has been replaced with a zinc-bearing function (generally noted —Zn—X' in which X' is halogen) which it has not been possible to obtain previously. Among the families of interest which it has not been possible to synthesize previously, mention should be made of the compounds derived from the preceding substrate formulae in which one of the radicals R, $R_1$, $R_2$ and $R_3$ is a monosubstituted and especially an unsubstituted aniline function.

Mention may also be made of compounds in which one of the radicals R, $R_1$, $R_2$ and $R_3$ is a group bearing a sulfone group (—$SO_2$—), including sulfonates, that is vicinal to the aromatic nucleus, that is to say that it is adjacent to it.

Finally, the dizinc compounds in which R is a zinc-bearing group.

The characteristics of these families may be cumulated to form preferred subfamilies.

The non-limiting examples which follow illustrate the invention.

General procedure (Condition A)

Apparatus

Single-compartment electrolysis cell equipped with a zinc anode and a nickel sponge cathode (gold or stainless steel cathodes may also especially be used).

Solvent: dimethylformamide/pyridine (45 ml/5 ml)

Ambient temperature (20 to 25°)

Aryl halide: 10 millimoles

Cobalt chloride: 1 millimole

Zinc bromide: 2.5 millimoles

Constant current: 0.2 A

No inert electrolyte

Electrode area: 20 $cm^2$

Electrolysis time: 2 hours

The conditions differing from the general procedure are specified in the tables below, which give a sample of the results obtained.

The asterisk * indicates that the yield measurement was performed by coupling the organozinc reagent with phenyliodide.

EXAMPLE 1

TABLE 1

In the case of aromatic halides

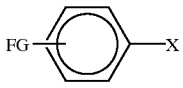

with FG = electron-donating group

| FGArX | FGArZnX % | ArH % | ArAr | Comments |
|---|---|---|---|---|
| PhCl | 6 | ? | 0 | 84% PhCl remaining |
| PhBr | 70 | ? | 0 | |
| PhI | 20 | Majority | 0 | All the PhI consumed |
| 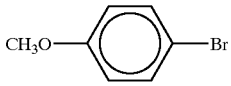 | 82 | 18 | 0 | |
| 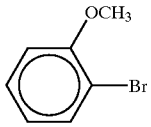 | 75 | 21 | 0 | |
| 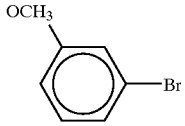 | 62 | 37 | 0 | |
| 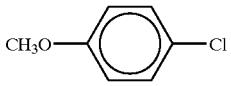 | 6 | 20 | | 74% ArCl remaining |
| 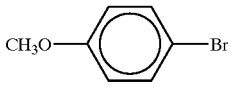 | 75 | 25 | 0 | FG—Ar—Ph 70% Isolated* |
| 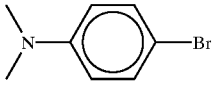 | 90 | 0 | 0 | FG—Ar—Ph 85% Isolated* |
| 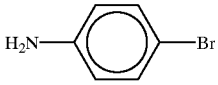 | 85 | | 0 | |

EXAMPLE 2
TABLE 2
In the case of aromatic halides
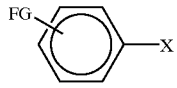
with FG = electron-withdrawing group
| FGArX | ArZnX % | ArH | ArAr | Comments |
|---|---|---|---|---|
| 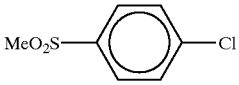  | 90 | ϵ | 0 | FG—Ar—Ph 80% Isolated |
| 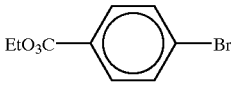  | 85 | | | |
| 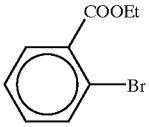  | 58 | | | 19% ArBr remaining |
| 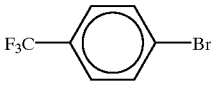  | 70 70 only | | | |
| 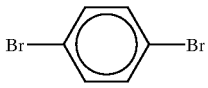  | 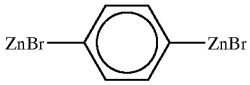  | | | |
| 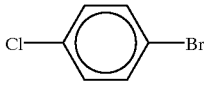  | 60 monozinc derivative (ClPhZnBr) | | | |
| 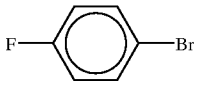  | 79 | | | |
| 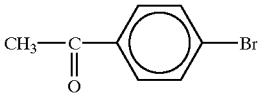  | 25 | | | disappearance of ArBr |
EXAMPLE 3
TABLE 3
In the case of heteroaromatic halides
| ArX | ArZnX % |
|---|---|
| 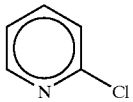  | 50 |
| 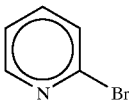  | 25 |
TABLE 3-continued
In the case of heteroaromatic halides
| ArX | ArZnX % |
|---|---|
| 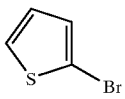  | 67 |
| 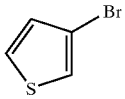  | 25 |

TABLE 3-continued

| In the case of heteroaromatic halides | |
|---|---|
| ArX | ArZnX % |
| 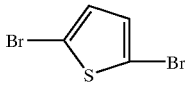 | 20 (monozinc derivative) |

In general, the thiophene derivatives show exceptional reactivity and it was possible in this case to perform a monoconversion of a dibromo derivative.

EXAMPLE 4

TABLE 4

| In the case of aliphatic halides | | | |
|---|---|---|---|
| RX | RZnX % | RH % | RY |
| $CH_3(CH_2)_3Br$ | 30 | 40 | |
| $Br(CH_2)_3COOEt$ | 42 | | |

EXAMPLE 5

TABLE 5

| In the case of vinyl halide | |
|---|---|
| Ph—CH=CHBr | PhCH=CHZnBr 45% |

The tests below were carried out by varying the operating conditions such as the nature of the anode, the concentration of catalyst, the concentration of zinc salts, or by using 2,2'-pyridine as ligand instead of pyridine.

EXAMPLE 6

TABLE 6

| ArX | ArZnX | Conditions |
|---|---|---|
| 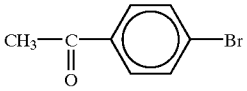 | 75 | $CoCl_2$, 1 eq, $ZnBr_2$, 2 eq, other conditions identical to A. |
| | 50 | $CoCl_2$ 0.2 eq, other conditions identical to A. |
| | 75 | $CoCl_2$, 0.4 eq, other conditions identical to A. |
| | 50 | 2 Bpy per Co, absence of pyridine, other conditions identical to A. |
| 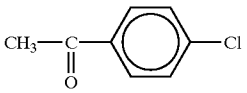 | 77 | $ZnBr_2$, 2 eq, $CoCl_2$, 1 eq, other conditions identical to A |
| 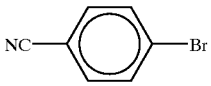 | 48 | 1 eq $ZnBr_2$, iron anode, other conditions identical to A. |
| | 70 | $ZnBr_2$, 2 eq, 1 eq $CoCl_2$, other conditions identical to A. |
| | 70 | $ZnBr_2$, 2 eq, 0.4 eq $CoCl_2$, other conditions identical to A. |

TABLE 6-continued

| ArX | ArZnX | Conditions |
|---|---|---|
| 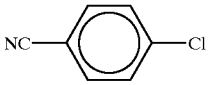 | 50 | $ZnBr_2$, 2 eq, 0.4 eq $CoCl_2$, other conditions identical to A. |
| | 65 | $ZnBr_2$, 2 eq, $CoCl_2$, 1 eq, other conditions identical to A. |
| 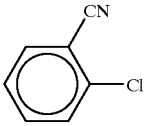 | 60 | $ZnBr_2$, 2 eq, $CoCl_2$, 0.4 eq, other conditions identical to A. |
| 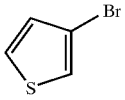 | 58 | $ZnBr_2$, 2 eq, $CoCl_2$, 1 eq, other conditions identical to A. |
| 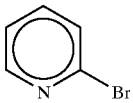 | 25 | 2 Bpy per $CoCl_2$, absence of pyridine, other conditions identical to A |

EXAMPLE 7

Formation of Organozinc Reagents from Ethyl Para-bromobenzoate, Study of Various Solvents THF made conductive with tetrabutylammonium fluoroborate gives good results for organozinc reagents, although slightly lower than in dimethylformamide. The other amides such as dimethylacetamide also give good yields of organozinc reagents. Nitriles such as acetonitrile give as much zinc reagent as when dimethylformamide is used.

EXAMPLE 8

The results obtained below were achieved in an acetonitrile/pyridine mixture (45/5). The other conditions were identical to the general conditions.

TABLE 7

| Electrosynthesis of organozinc reagents in acetonitrile/pyridine medium (V/V = 9/1) | |
|---|---|
| ArX | ArZnX |
| 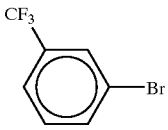 | 80% |
| 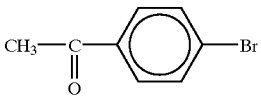 | 57% |
| 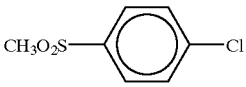 | 90% |

TABLE 7-continued

| Electrosynthesis of organozinc reagents in acetonitrile/pyridine medium (V/V = 9/1) | |
|---|---|
| ArX | ArZnX |
| 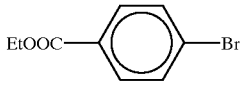 | 80% |

The use of benzonitrile instead of pyridine (9/1 mixture by volume) also leads to good results under the general conditions. In particular, starting with meta-bromofluorobenzene, a yield of 60% is obtained.

EXAMPLE 9

1. Ligands Other than Pyridine and Benzonitrile

Starting with pBr-PhCO$_2$Et under the general conditions described above (conditions A), the following results are obtained:

| Solvent | Ligand | BrZnPhCO$_2$Et |
|---|---|---|
| Acetonitrile (45 ml) | Adiponitrile (5 ml) | 75% |
| Acetonitrile (45 ml) | 1,2-dimethoxyethane (5 ml) | 65% |
| acetonitrile (45 ml) | 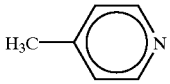 (5 ml) | 50% |

2. Formation of Aromatic and Heteroaromatic Dizinc Reagents from Aromatic Dihalides (X—Ar—X)

General conditions identical to conditions A, but:

the solvent is acetonitrile (45 ml)/pyridine (5 ml), $CoCl_2$ 2 millimoles, electrolysis stopped after 4 Faradays have been passed per mole of X—Ar—X (4 hours)

| X—Ar—X | X—ArZn (%) | XZn—Ar–ZnX (%) |
|---|---|---|
| 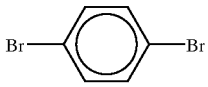 | 0 | 70 |
| 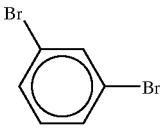 | 0 | 51 |
| 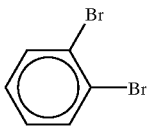 | 0 | 16 |

-continued

| X—Ar—X | X—ArZn (%) | XZn—Ar–ZnX (%) |
|---|---|---|
| 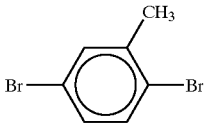 | 0 | 66 |
| 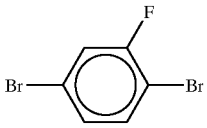 | 0 | 65 |
| 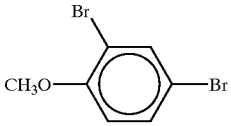 | 0 | 44 |
| 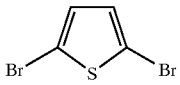 | 0 | 28 |
| 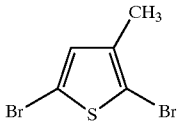 | 0 | 26 |
| 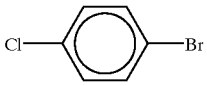 | 38 Pcl—Ph—ZnBr | 30 |
| 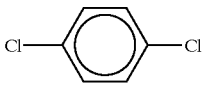 | 28 | 10 |
| 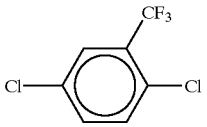 | 73 | 19 |
| 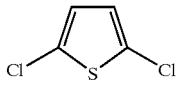 | 26 | 2 |

What is claimed is:

1. A liquid conductive composition for electrolytic use, comprising a cobalt salt, a zinc salt, a polar aprotic solvent of said salts and a cobalt ligand.

2. A liquid conductive composition according to claim 1, wherein the cobalt is present in a concentration of between $10^{-3}$ M and 0.2 M.

3. A liquid conductive composition according to claim 1, wherein the solvent has a donor number D greater than or equal to 10 and less than or equal to 30.

4. A liquid conductive composition according to claim 1, wherein the ligand and the solvent are a single compound.

5. A process for the electrolytic synthesis of an organozinc compound, comprising the step of subjecting to an electrolysis on an inert cathode a composition comprising a cobalt salt, a zinc salt, a solvent, a cobalt ligand, and an organic halide and recovering said organozinc formed by said electrolysis.

6. A process according to claim 5, wherein the organozinc compound is an aromatic or vinyl organozinc compound.

7. A process according to claim 5 wherein the cobalt is present in the composition in oxidation state II.

8. A process according to claim 5 wherein the ligand and the solvent are a single compound.

9. A process according to claim 5, wherein the ligand has a coordinating atom to the cobalt which is nitrogen.

10. A process according to claim 5, wherein the ligand does not act as solvent and is a compound having a pyridine, nitrile, phosphine, stibine or imine function.

* * * * *